US012630380B2

(12) United States Patent
Sakamoto

(10) Patent No.: US 12,630,380 B2
(45) Date of Patent: May 19, 2026

(54) ROLLER PAIR FOR CONVEYING SHEETS AND PRINTING APPARATUS

(71) Applicant: RISO KAGAKU CORPORATION, Tokyo (JP)

(72) Inventor: Masayoshi Sakamoto, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 108 days.

(21) Appl. No.: 18/389,263

(22) Filed: Nov. 14, 2023

(65) Prior Publication Data

US 2024/0190673 A1 Jun. 13, 2024

(30) Foreign Application Priority Data

Dec. 12, 2022 (JP) ..... 2022-197730

(51) Int. Cl.

| | |
|---|---|
| ***B65H 5/06*** | (2006.01) |
| ***B65H 27/00*** | (2006.01) |
| ***B65H 29/12*** | (2006.01) |
| ***B65H 29/20*** | (2006.01) |

(52) U.S. Cl.
CPC ..... *B65H 5/062* (2013.01); *B65H 2404/111* (2013.01)

(58) Field of Classification Search
CPC .... B65H 2404/1115; B65H 2404/1118; B65H 2404/1119; B65H 2404/1321; B65H 2404/132; B65H 2404/133; B65H 2404/1416; B65H 2404/1415; B65H 2404/1414; B65H 5/062; B65H 29/20; B65H 27/00; B65H 3/0683; B65H 29/12; B65H 29/125; B41J 13/076
See application file for complete search history.

(56) References Cited

U.S. PATENT DOCUMENTS

| | | | | |
|---|---|---|---|---|
| 5,580,043 A * | 12/1996 | Gelb, Jr. | ..... | B65H 27/00 271/274 |
| 6,139,006 A * | 10/2000 | Asada | ..... | B65H 3/0638 271/121 |
| 2006/0180989 A1* | 8/2006 | Seike | ..... | B65H 3/66 271/121 |
| 2019/0270603 A1* | 9/2019 | Chiba | ..... | B65H 3/0638 |

FOREIGN PATENT DOCUMENTS

| | | |
|---|---|---|
| JP | 5-32350 A | 2/1993 |

* cited by examiner

*Primary Examiner* — Luis A Gonzalez
(74) *Attorney, Agent, or Firm* — Greenblum & Bernstein, P.L.C.

(57) ABSTRACT

A roller pair for conveying sheets is equipped with a first roller and a second roller that sandwich and convey sheet members. At least one of the first roller and the second roller has a concave-convex portion on the surface thereof, and the at least one of the rollers having the concave-convex portion on the surface thereof further has flange portions and at both ends in the axial direction thereof.

4 Claims, 9 Drawing Sheets

ROLLER PAIR FOR CONVEYING SHEETS AND PRINTING APPARATUS

CROSS-REFERENCE TO RELATED APPLICATIONS

The present application claims priority under 35 U.S.C. § 119 to Japanese Patent Application No. 2022-197730, filed on Dec. 12, 2022. The above applications are hereby expressly incorporated by reference, in these entireties, into the present application.

BACKGROUND OF THE INVENTION

1. Field of the Invention

The present disclosure is related to a roller pair for conveying sheets such as printing paper and a printing apparatus.

2. Description of the Related Art

Conventional conveyance roller pairs are employed as a mechanism for conveying sheet members such as printing paper. Rubber rollers are employed as conveyance roller pairs, but when conveyance roller pairs constituted by rubber rollers are employed in printing apparatuses that perform double sided printing, for example, there is a problem that when a sheet member on which printing has been conducted on one side is conveyed, ink on the surface of the sheet member is easily transferred to the rubber rollers, causing the sheet member to be contaminated.

SUMMARY OF THE INVENTION

Therefore, for the purpose of reducing the aforementioned contamination and improving grip, employing rollers with convex and concave portions formed on the surfaces thereof by adhesively attaching aluminum oxide or diamonds to the roller surface, or by covering the surfaces of rollers with knitted fabric, maybe considered. By forming concave-convex portions on the surfaces of the rollers, the contact area between the rollers and the sheet member can be decreased, and contamination of the sheet member can be reduced.

Meanwhile, when a sheet member is conveyed, the sheet member is nipped and conveyed by conveyance roller pairs. However, depending on the curvature of the conveyance path or the curl or skew of the sheet member, the leading edge of the sheet member may be guided to the nipping point while hitting the surfaces of the rollers. FIG. 9 is a diagram that schematically illustrates how the leading edge of a sheet member P is guided to a nipping point while hitting the surface of a roller 100 when there is a curvature in a conveyance path r. The dashed lines illustrated in FIG. 9 shows the manner in which the sheet member P moves.

Even if the convey speed of the sheet member and the receiving speed of the roller are equal, the moment that the leading edge of the sheet member hits the surface of the roller, the leading edge of the sheet member enters a concavity of the concave-convex portions, causing the leading edge of the sheet member to bend, resulting in damage to the leading edge of the sheet member due to the collision with the surface of the roller.

To reduce collisions with the surfaces of rollers, there are methods to decrease the amount that rollers protrude into a conveyance path or to install guides in front of the rollers such that a sheet member directly enters a nipping point between a driving roller and a driven roller. However, these methods are difficult to realize in actuality due to margins of error in the installation of rollers and variations in parts such as guides.

Japanese Unexamined Patent Publication No. H5-032350 proposes to guide the leading edge of a sheet member to a driven roller side by adjusting the position of a guide plate which is placed in front of the roller. However, collision of the sheet member with the driven roller cannot be avoided by this method, and the above technical problem cannot be solved.

It is an object of the present disclosure to provide a roller pair for conveying sheets and a printing apparatus which is capable of reducing contamination of sheet members while suppressing the occurrence of damage at the leading edges of the sheet members.

A roller pair for conveying sheets of the present disclosure has a first roller and a second roller that sandwich and convey a sheet member, at least one of the first roller and the second roller having a concave-convex portion, and the at least one of the rollers having the concave-convex portion on the surface thereof further having flange portions at both ends in the axial direction of the roller.

According to the roller pair for conveying sheets of the present disclosure, flange portions are provided at both axial ends of the at least one roller which has a concave-convex portion, which reduces contamination of the sheet member and prevents damage to the leading edges of sheet members.

DETAILED DESCRIPTION OF THE EMBODIMENTS

Figure 1:
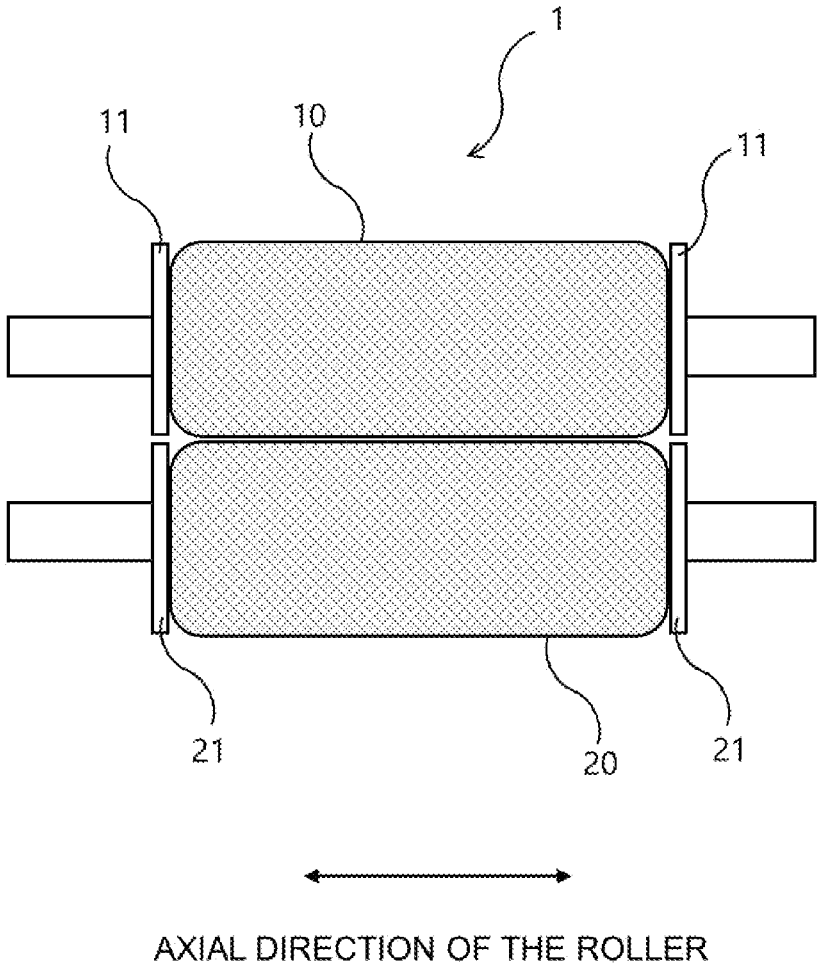
FIG. 1 is a diagram that schematically illustrates a roller pair that employs an embodiment of a roller pair for conveying sheets of the present disclosure.

Hereinafter, a conveyance roller pair that employs an embodiment of a roller pair for conveying sheets of the present disclosure will be described in detail with reference to the attached drawings. FIG. 1 is a perspective view that schematically illustrates a conveyance roller pair 1 of the present embodiment.

The conveyance roller pair 1 of the present embodiment has a first roller 10 and a second roller 20, as illustrated in FIG. 1. The first roller 10 and the second roller 20 are provided such that they face each other, and the first roller 10 and the second roller 20 are provided at an interval that enables sheet members such as printing paper to be sandwiched therebetween and conveyed.

The first roller 10 and the second roller 20 of the present embodiment are rollers having a number of concave-convex portions on their surfaces. In FIG. 1, the concave-convex portions are schematically represented by a mesh-like pattern, in which convex areas are illustrated in white and concave areas are illustrated in gray.

Knurled rollers such as twill knurled rollers and flat knurled rollers, rollers with particles which are ceramic particles such as aluminum oxide, or diamond particles bonded to the roller surface, and rollers whose entire surfaces are covered with knitted or woven fabrics, may be employed as the first roller 10 and the second roller 20.

In the case that knurled rollers are employed, the knurling process may be either a rolling or a cutting process.

Knitted fabrics are fabrics made by knitting yarns, while woven fabrics are fabrics made by combining yarns horizontally and vertically. Knitted fabrics may be weft knitted, such as weft knitting and circular knitting, or warp knitted, such as tricot, double raschel, and single raschel knitting. Knitted or woven fabrics form concave-convex portions by knitting or weaving.

By employing rollers with concave-convex portions as the first roller 10 and the second roller 20 in this manner, contact with the sheet member can become point contact and contact area can be reduced. Therefore, adhesion of colorants on a printed sheet member onto the surfaces of the first roller 10 and the second roller 20 can be suppressed.

Meanwhile, if the surfaces of the first 10 and second 20 rollers are provided with the concave-convex portions, there is a risk of damaging the leading edge of the sheet member, as described above.

Therefore, flange portions 11 are provided at both ends of the first roller 10 and flange portions 21 are provided at both ends of the second roller 20 in order to suppress damage to the leading edge of the sheet member, as illustrated in FIG. 1.

The flange portions 11 are of donut shapes and are provided at both axial ends of the first roller 10. Each of the flange portions 11 has an outer diameter which is higher than the bottoms of the concave portions and lower than the heights of the convex portions of the concave-convex portion of the first roller 10. It is preferable for the thickness of the flange portions 11 in the axial direction to be greater than or equal to 0.5 mm and less than or equal to 2 mm. The outer diameter of the flange portions 11 may be greater than the heights of the convex portions to a degree that the influence on the sheet member to be conveyed is within an acceptable range.

The flange portions 21 are of donut shapes and are provided at both axial ends of the second roller 20. Each of the flange portions 21 has an outer diameter which is higher than the bottoms of the concave portions and lower than the heights of the convex portions of the concave-convex portion of the second roller 20. It is preferable for the thickness of the flange portions 21 in the axial direction to be greater than or equal to 1 mm and less than or equal to 2 mm. Note that the outer diameter of the flange portions 21 may also be larger than the height of the convex portion to a degree that the influence on the sheet member being conveyed is within an acceptable range.

According to the conveyance roller pair 1 of the above embodiment, the flange portions 11 and 21 are provided on the first roller 10 and the second roller 20 at both ends in the axial direction thereof. Therefore, when the leading edge of the sheet member is about to collide with the surface of the first roller 10 or the second roller 20, the flange portions 11 and 21 can prevent the leading edge of the sheet member from entering the concave portions of the first roller 10 or the second roller 20. Thereby, damage to the leading edge of the sheet member can be reduced, while contamination of the sheet member due to transfer from the rollers can also be decreased.

In addition, the outer diameters of the flange portions 11 and 21 are set to be between the tops of the convex portions and the bottom of the concave portions of the concave-convex portions of the first roller 10 and the second roller 20. Therefore, the flange portions 11 and 21 do not extend beyond the convex portions of the concave-convex portions. As a result, no influence is imparted by the flange portions 11 and 21 on the sheet member which is being conveyed.

Further, the main roller body of the first roller 10 and the flange portion 11, and the main roller body of the second roller 20 and the flange portion 21 are respectively formed along the same axis. Therefore, it is easy to achieve precision in the components, and the rollers can be produced exactly as designed.

Figure 2:
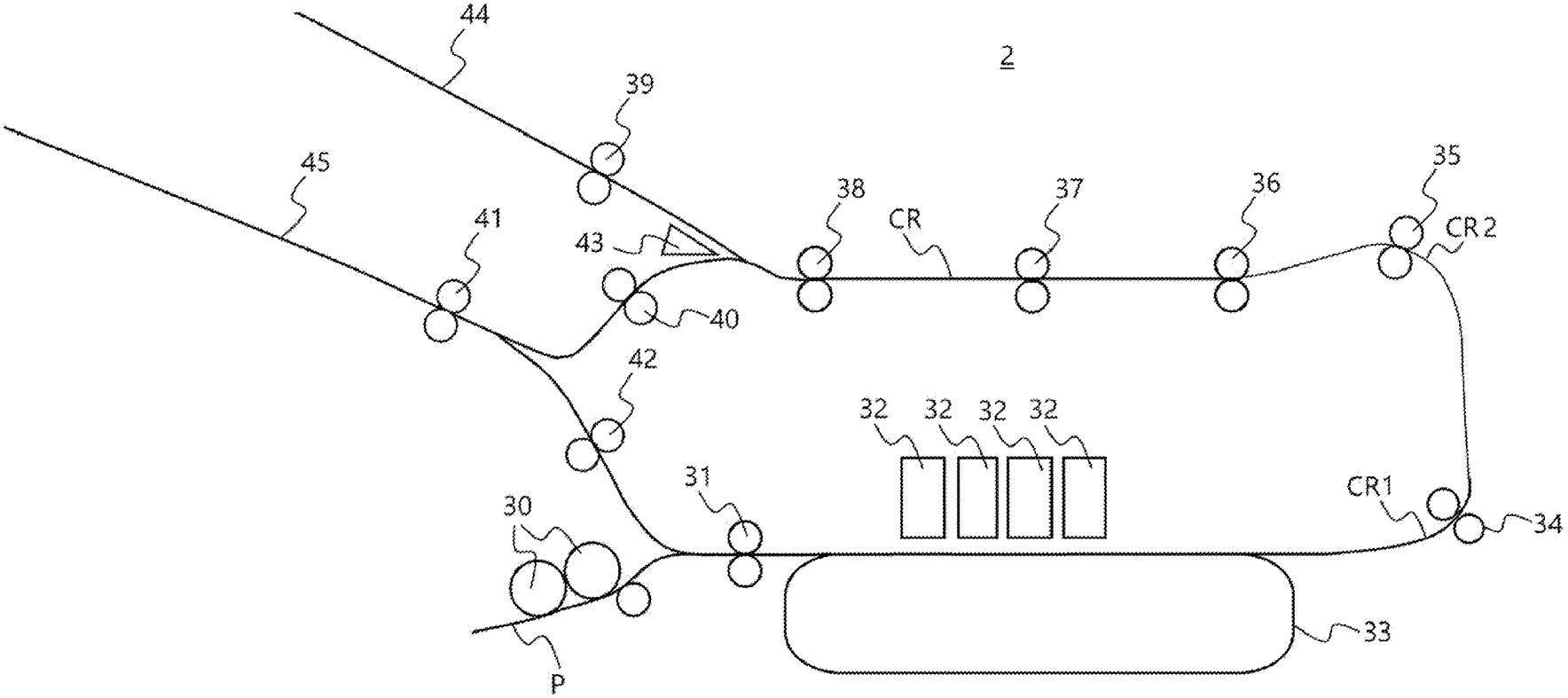
FIG. 2 is a diagram that schematically illustrates the configuration of an inkjet printing apparatus that employs the embodiment of the roller pair for conveying sheets of the present disclosure.

Next, an inkjet printing apparatus 2 equipped with the conveyance roller pair 1 of the above embodiment will be described. FIG. 2 is a diagram that schematically illustrates the configuration of the inkjet printing apparatus 2.

The inkjet printing apparatus 2 of the present embodiment is equipped with a paper feeding roller 30, a registration roller 31, four line heads 32, a conveyor belt 33, a circulating conveyance path CR, first through fifth circulating conveyance rollers 34 through 38, a paper discharge roller 39, a first reversing conveyance roller 40, a reversing roller 41, and a second reversing conveyance roller 42.

In the inkjet printing apparatus 2, a sheet member P at the topmost position is ejected from a feeding table, which is omitted from the drawing, by the feeding roller 30 and conveyed to the registration roller 31.

The leading edge of the sheet member P which is conveyed from the feeding roller 30 contacts the registration roller 31, causing the sheet member P to pause, thereby forming slack, which is employed to correct movement in an oblique direction.

The registration roller 31 starts rotating at a predetermined timing and conveys the sheet member P toward the conveyor belt 33.

The sheet member P that reaches the conveyor belt 33 is adsorbed onto the conveyor belt 33 and conveyed under the line heads 32. Ink is then ejected from each of the line heads 32 onto the sheet member P, thereby administering a printing process on a surface of the sheet member P.

Each of the line heads 32 has a plurality of inkjet heads which are arrayed in a direction perpendicular to the direction of the sheet member P. The line heads 32 eject ink onto the sheet member P which is conveyed by the conveyor belt 33. The four line heads 32 are arranged at predetermined intervals along the conveyance path of the sheet member P, as illustrated in FIG. 2. The four line heads 32 eject C (cyan), M (magenta), Y (yellow), and K (black) ink, respectively.

The sheet member P, on which the printing process has been administered by the four line heads 32, is conveyed along the circulating conveyance path CR by the first through fifth circulating conveyance rollers 34 to 38 located along the circulating conveyance path CR.

Beyond the fifth circulating conveyance roller 38, a switching mechanism 43 is provided to switch between guiding the sheet member P to the side of the paper discharge roller 39 or to the side of the first reversing conveyance roller 40.

In the case that single sided printing is performed, the sheet member P of which one side has been printed is guided by the switching mechanism 43 to the side of the paper discharge roller 39 and is discharged to a paper discharge tray 44. On the other hand, in the case that double sided printing is performed, of which one side has been printed is guided by the switching mechanism 43 to the side of the first reversing conveyor roller 40.

The sheet member P which is guided to the first reversing conveyance roller 40 by the switching mechanism 43 is conveyed toward the reversing roller 41 by the first reversing conveyance roller 40.

The reversing roller 41 conveys the sheet member P toward a reversing table 45 and back again from the reversing table 45, thereby conveying the sheet member P toward the second reversing conveyance roller 42 with the front and back surfaces thereof reversed.

The sheet member P, the front and back surfaces of which have been reversed, is conveyed again by the second reversing conveyance roller 42 to the registration roller 31, and is conveyed again by the registration roller 31 to the line heads 32 at a predetermined timing. Then, the line head administers a printing process on the back surface of the sheet member P.

The sheet member P, on which the printing process has been administered on the back surface thereof, is conveyed by the first through fifth circulating conveyance rollers 34 through 38, and then conveyed by the paper discharge roller 39 via the switching mechanism 43 to the paper discharge tray 44.

The conveyance roller pair 1 of the above embodiment is provided along the circulating conveyance path CR and preferably along a curved conveyance path where the sheet member P is conveyed in a curved manner, for example. Specifically, it is preferable to employ the conveyance roller pair 1 of the above embodiment as the first circulating conveyance roller 34 provided along a curved conveyance path CR1 and the second circulating conveyance roller 35 provided along a curved conveyance path CR2 along the circulating conveyance path CR. By adopting this configuration, damage to the leading edge of the sheet member P that tends to occur along the curved conveyance path can be more reliably suppressed.

In the conveyance roller pair 1 of the above embodiment, both the first roller 10 and the second roller 20 are provided with flange portions 11 and 21, respectively. Alternatively, a flange portion may be provided only on either the first roller 10 or the second roller 20. In such a case, when the first roller 10 and the second roller 20 are provided along a curved conveyance path, it is preferable to provide a flange portion on the roller which is provided on the exterior side of the curve, for example, on an outer roller of a pair of rollers that constitute the first circulating conveyance roller 34 or an outer roller of a pair of rollers that constitute the second circulating conveyance roller 35.

Figure 3:
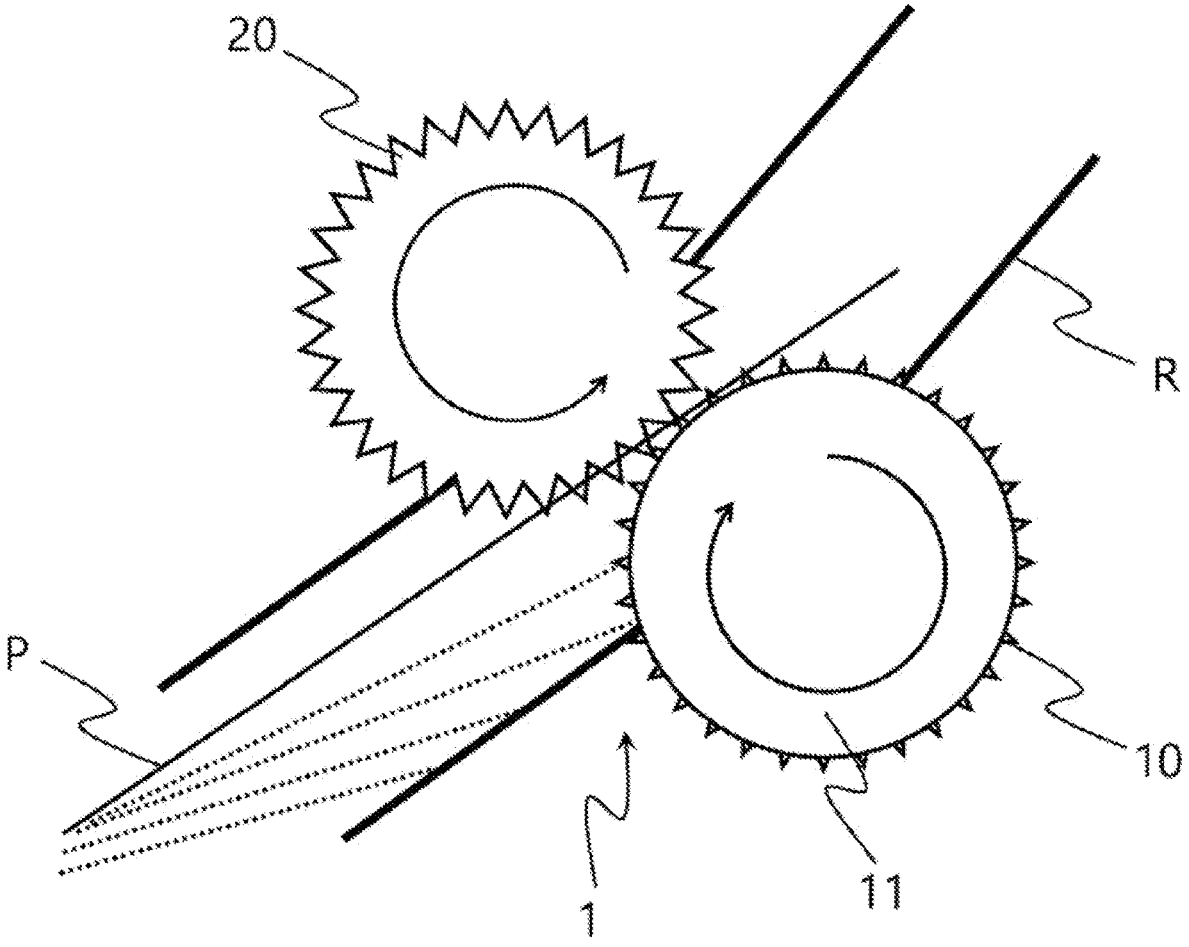
FIG. 3 is a diagram that illustrates an example of a first roller with a flange portion provided at an exterior side of a curved conveyance path.

FIG. 3 is a diagram that illustrates an example in which a conveyance roller pair 1 is provided along a curved conveyance path R. FIG. 3 illustrates an example in which a flange portion 11 is provided on a first roller 10 at the exterior side of the curved conveyance path R. The dashed lines in FIG. 3 illustrate the manner of movement of the sheet member P. As illustrated in FIG. 3, even when the sheet member is guided to a nipping point while abutting the surface of the outer roller 100, the occurrence of damage to the leading edge of the sheet member can be more reliably controlled.

Figure 4:
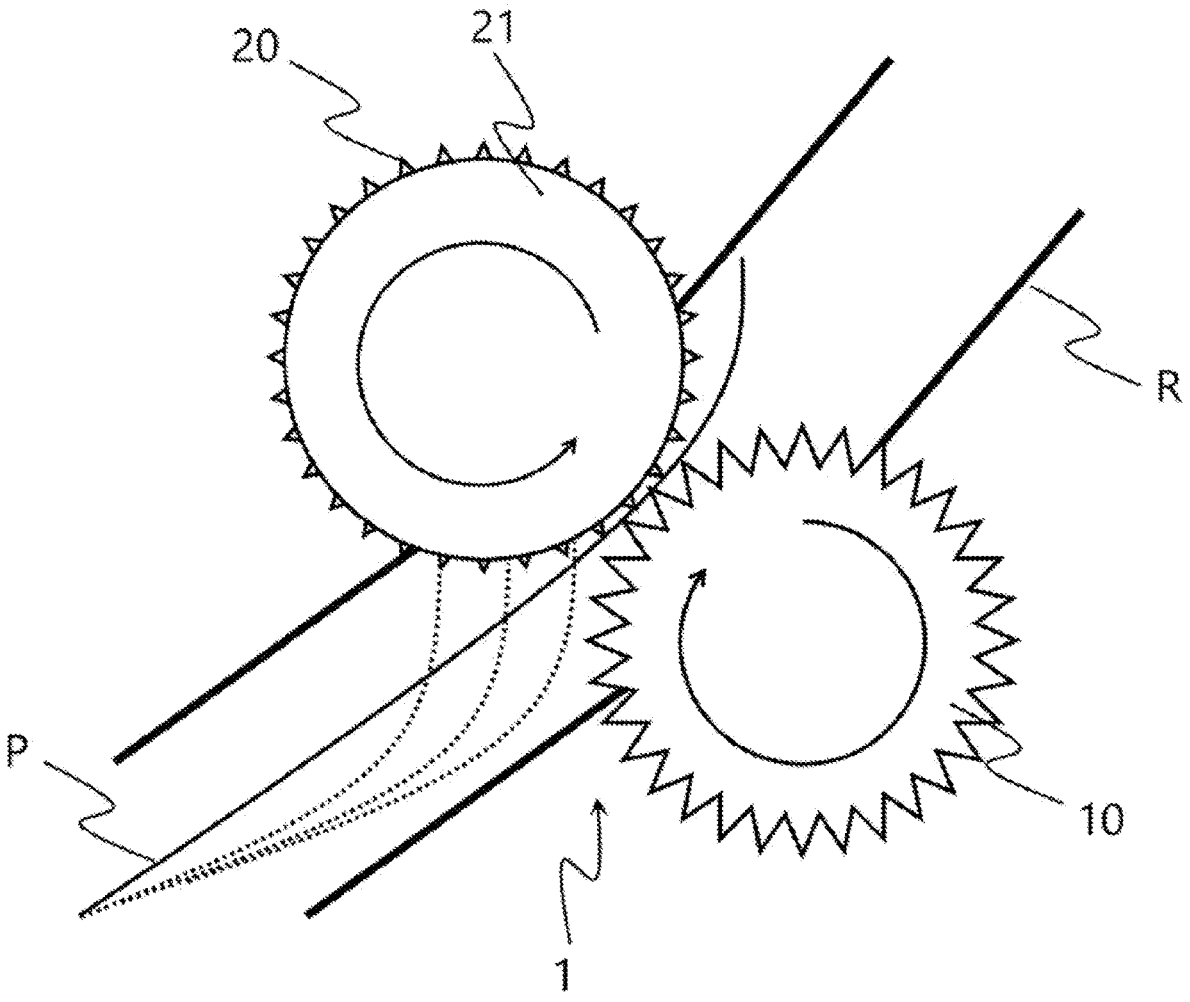
FIG. 4 is a diagram that illustrates an example of a second roller provided with a flange portion at an interior side of the curved conveyance path.

Note that in the case that the conveyance roller pair 1 is provided along the curved conveyance path R, a flange portion may be provided on the roller which is provided at the interior side of the curvature. FIG. 4 illustrates an example in which a conveyance roller pair 1 is provided along the curved conveyance path R. In FIG. 4, an example is illustrated in which a flange portion 21 is provided on a second roller 20 at the interior of the curved conveyance path R. The dashed lines in FIG. 4 illustrate the movement of the sheet member P. As illustrated in FIG. 4, in the case that the flange portion 21 is provided on the second roller 20 at the interior side of the curved conveyance path R, for example, even if the leading edge of the sheet member P is curled toward the second roller 20, the leading edge of the sheet member P can be prevented from entering the concave-convex concave portion of the second roller 20. As a result, the occurrence of damage to the leading edge of the sheet member P can be more reliably suppressed.

Figure 5:
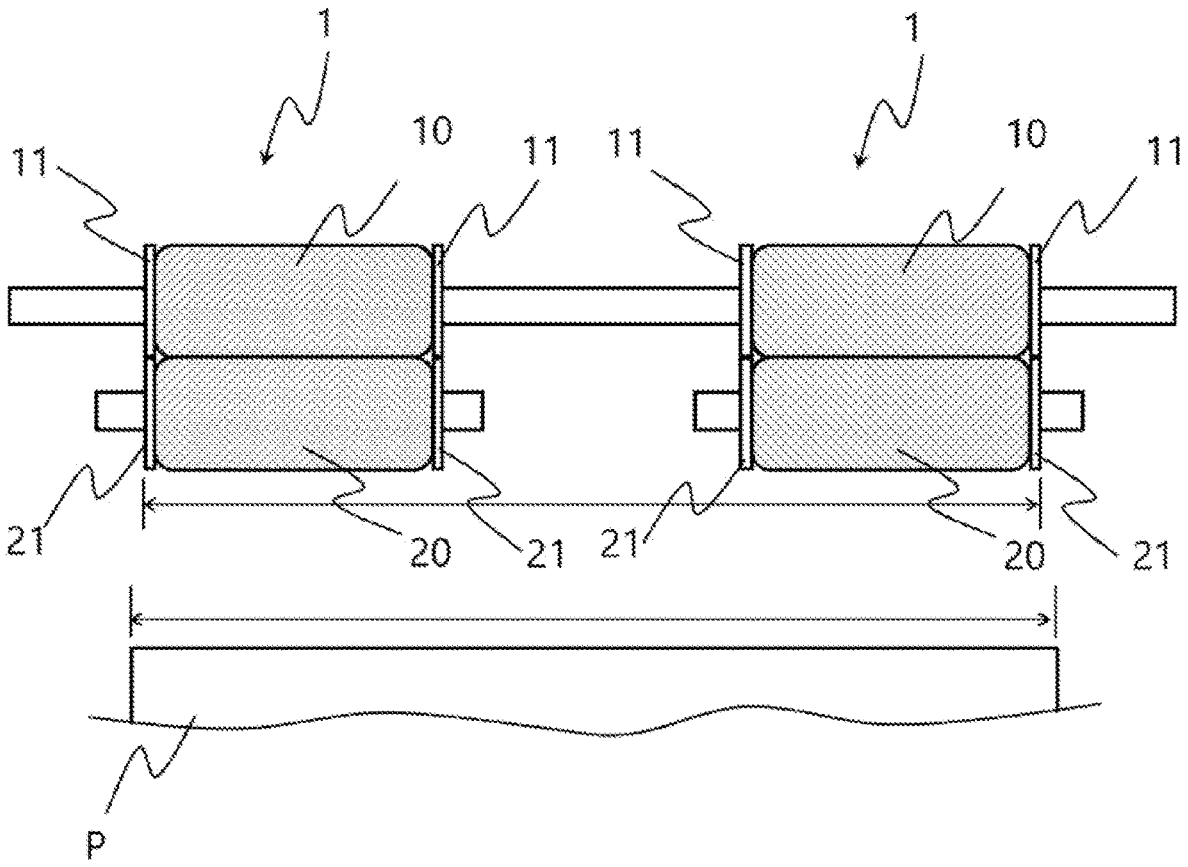
FIG. 5 is a diagram that illustrates an example in which two conveyance roller pairs are provided.

In addition, in the case that the conveyance roller pair 1 of the above embodiment is employed in the inkjet printing apparatus 2, it is preferable for the flange portions 11 and 21 at both ends of the first roller 10 and the second roller 20 to be arranged inside the width (length in a direction perpendicular to the conveyance direction) of the sheet member P to be conveyed, as illustrated in FIG. 5. This enables the flange portions 11 and 21 to more securely contact the sheet member P to be conveyed prior to the main bodies of the rollers.

Figure 6:
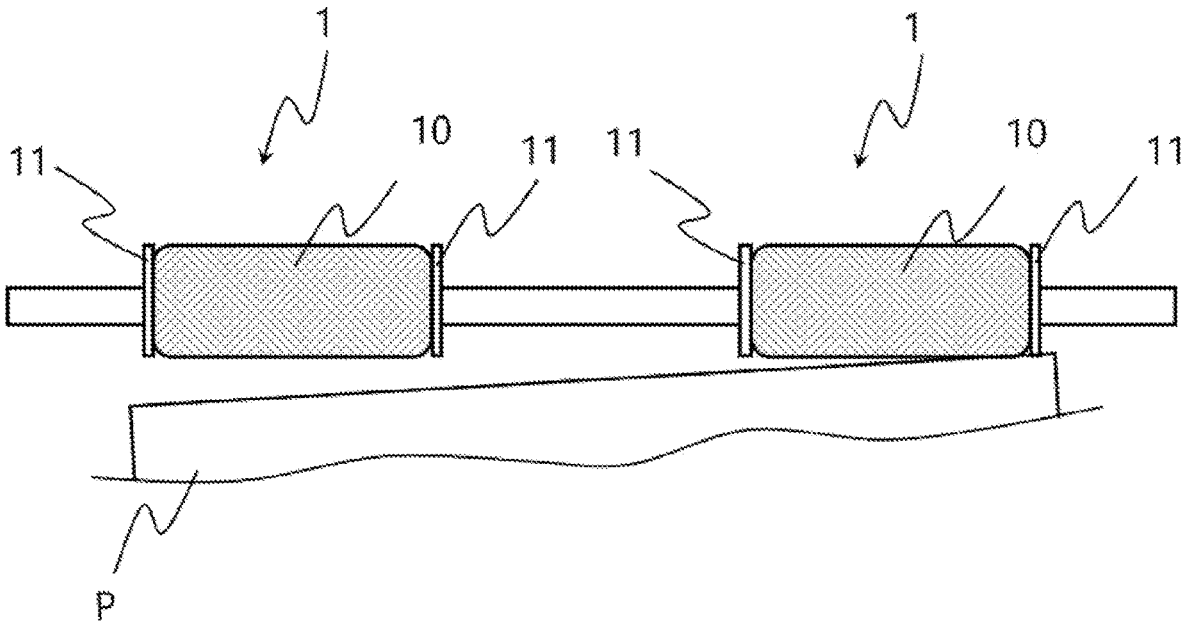
FIG. 6 is a diagram for explaining the operation of a conveyance roller pair in a case that a sheet member is conveyed at an inclined angle.

FIG. 6 is a diagram that illustrates an example of two conveyance roller pairs 1 provided in a direction perpendicular to the direction of conveyance of the sheet member P. For the sake of convenience, the two second rollers 20, 20 are omitted from the drawing. In the case that the conveyance roller pair 1 is provided as illustrated in FIG. 6, for example, even when the sheet member P is conveyed at an oblique angle, the leading edge of the sheet member P can easily abut the flange portions 11 and 21 first, and the leading edge of the sheet member P is less likely to collide with the concave-convex portions of the first roller 10 and second roller 20.

Figure 7:
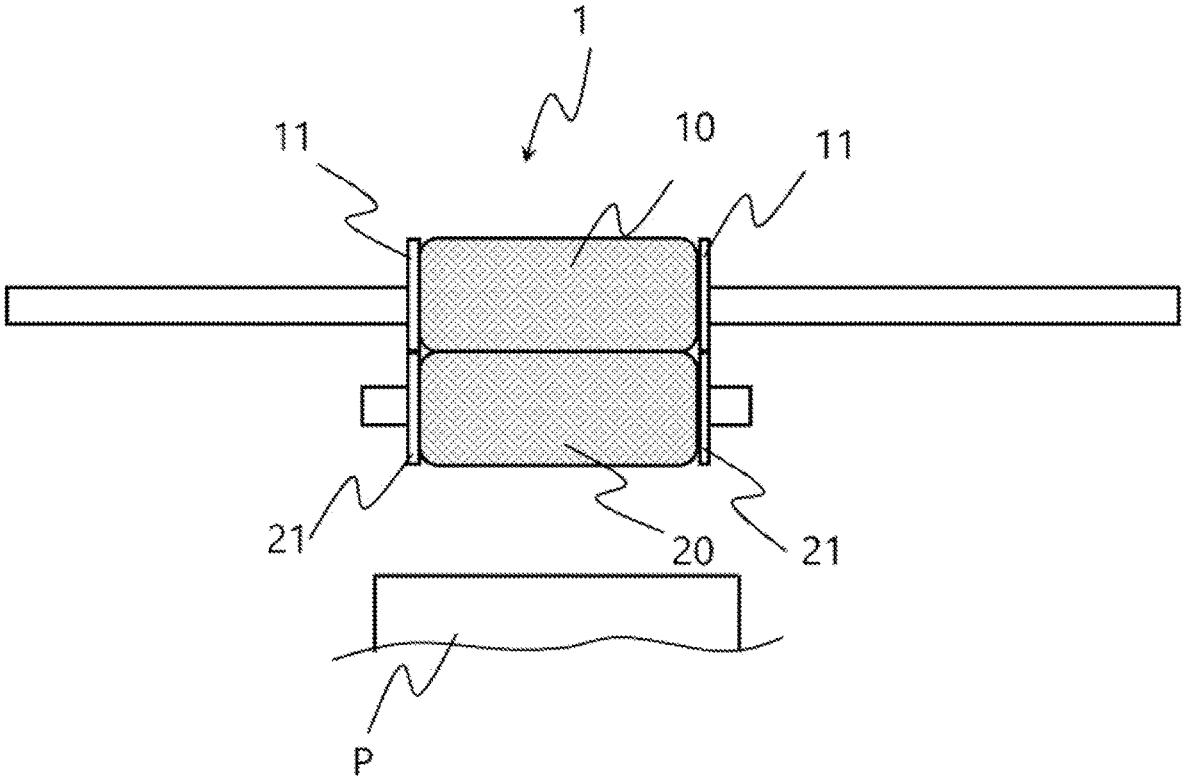
FIG. 7 is a diagram that illustrates the relationship between a sheet member and a conveyance roller pair in a case that the sheet member is narrow.
Figure 8:
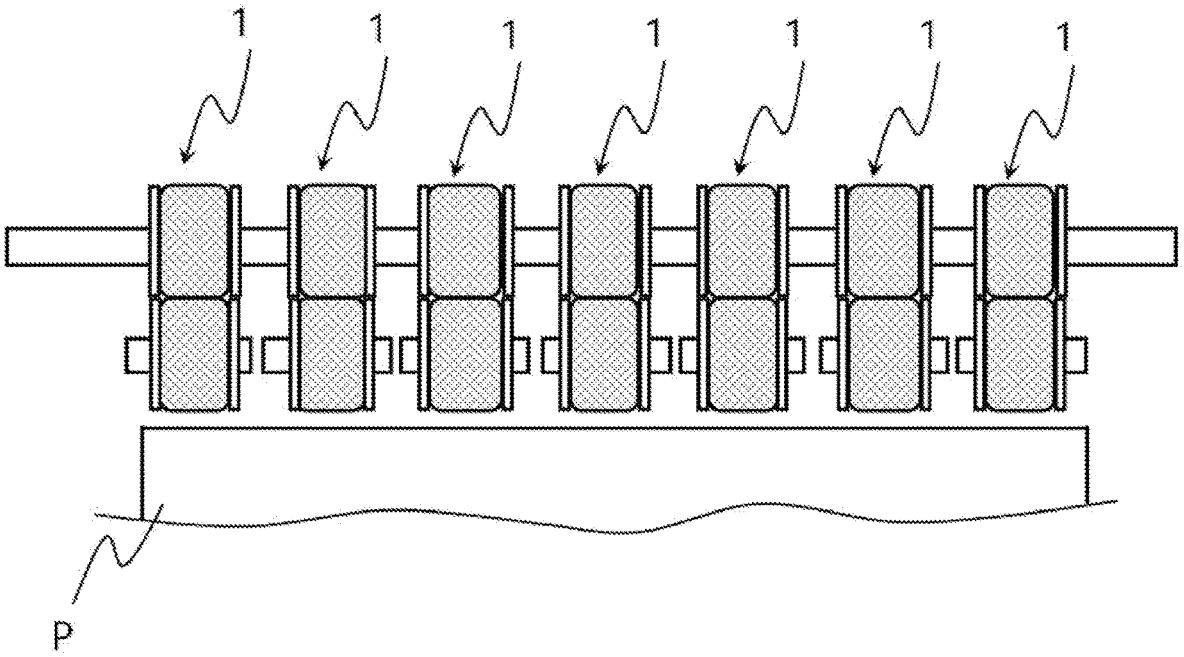
FIG. 8 is a diagram that illustrates an example in which three or more conveyance roller pairs are provided.
Figure 9:
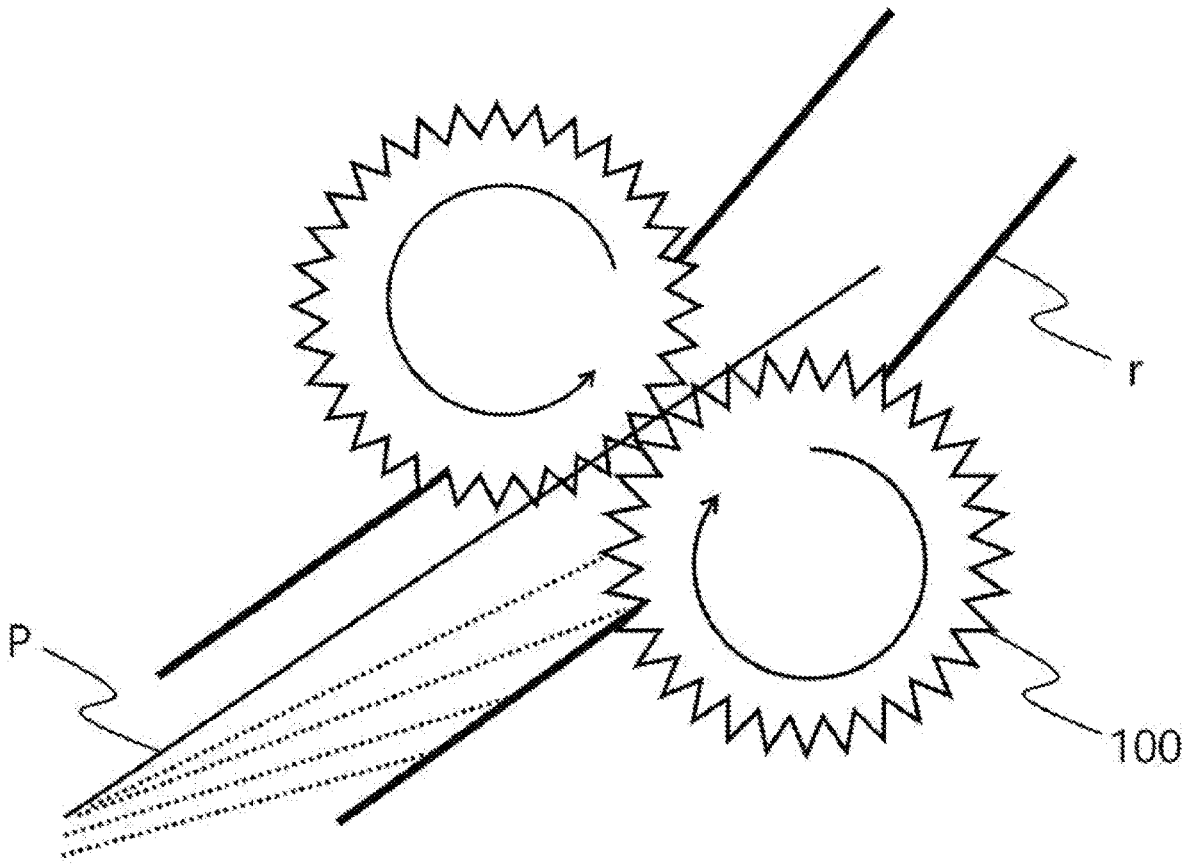
FIG. 9 is a diagram for explaining the factors that cause damage to the leading edge of a sheet member.

FIG. 7 is a diagram that illustrates an example of a case in which the width of the sheet member P is narrow, and in this case, even with one conveyance roller pair 1, the flange portions 11 and 21 at both ends of the first roller 10 and second roller 20 can be arranged inside the sheet member P. In addition, as illustrated in FIG. 8, three or more conveyance roller pairs 1 may be provided in a direction perpendicular to the conveyance direction of the sheet member P.

Note that the present disclosure is not limited to the embodiments described above, but may be realized by modifying the components to a degree that does not depart from the spirit thereof at the stages of implementation. In addition, various configurations can be formed by appropriate combinations of the plurality of components disclosed in the above embodiments. For example, all of the components disclosed in the embodiments may be combined as appropriate. It is a matter of course that it is possible to make various modifications and applications within a scope that does not depart from the spirit of the disclosure.

With respect to the present disclosure, the following additional items are further disclosed.

(Item 1)

The roller pair for conveying sheets has a first roller and a second roller that sandwich and convey a sheet member, at least one of the first roller and the second roller having a concave-convex portion on the surface thereof, and the at least one of the rollers having the concave-convex portion on the surface thereof further having flange portions at both ends in the axial direction of the roller.

(Item 2)

In the roller pair for conveying sheets of Item 1, the flange portions may have an outer diameter which is higher than the bottoms of the concave portions and lower than the heights of the convex portions of the concave-convex portion.

(Item 3)

It is preferable for the roller pair for conveying sheets of Item 1 or Item 2 to be provided along a curved conveyance path in which the sheet member is conveyed in a curved manner.

(Item 4)

It is preferable for the roller pair for conveying sheets of Item 3 to be that in which the first or second roller provided at the exterior side of the curvature of the curved conveyance path has flange portions.

(Item 5)

The printing apparatus of the present disclosure is equipped with a roller pair for conveying sheets of any one of Items 1 through 4.

What is claimed is:

1. A roller pair for conveying sheets, comprising:

a first roller and a second roller that sandwich and convey a sheet member;

at least the first roller has a concave-convex portion on a surface thereof as viewed from an axial direction of the first roller; and the at least first roller having the concave-convex portion on the surface thereof further has flange portions at both ends in the axial direction of the first roller, wherein the flange portions have an outer diameter which is higher than the bottoms of the concave portions and lower than the heights of the convex portions of the concave-convex portion as viewed from the axial direction of the first roller.

2. A roller pair for conveying sheets, comprising:

a first roller and a second roller that sandwich and convey a sheet member;

at least the first roller has a concave-convex portion on a surface thereof as viewed from an axial direction of the first roller; and the at least first roller having the concave-convex portion on the surface thereof further has flange portions at both ends in the axial direction of the first roller, wherein the second roller has the concave-convex portion on a surface thereof, and wherein the second roller having the concave-convex portion on the surface thereof further has flange portions at both ends in the axial direction of the second roller.

3. The roller pair for conveying sheets as defined in claim 2, wherein the flange portions of the second roller have an outer diameter which is higher than the bottoms of the concave portions and higher than the heights of the convex portions of the concave-convex portion of the second roller.

4. A roller pair for conveying sheets, comprising:

a first roller and a second roller that sandwich and convey a sheet member;

at least the first roller has a concave-convex portion on a surface thereof as viewed from an axial direction of the first roller; and the at least first roller having the concave-convex portion on the surface thereof further has flange portions at both ends in the axial direction of the first roller, wherein the flange portions have an outer diameter which is higher than the bottoms of the concave portions and higher than the heights of the convex portions of the concave-convex portion.

* * * * *